US005584419A

United States Patent [19]

Lasko

[11] Patent Number: 5,584,419

[45] Date of Patent: Dec. 17, 1996

[54] MAGNETICALLY HEATED SUSCEPTOR

[76] Inventor: Bernard C. Lasko, 2605 Colonial Pkwy., Forth Worth, Tex. 76109

[21] Appl. No.: 437,290

[22] Filed: May 8, 1995

[51] Int. Cl.[6] ..... B67D 5/62; H05B 6/10

[52] U.S. Cl. ..... 222/146.5; 219/630; 219/647; 219/660; 219/240; 219/241; 222/333

[58] Field of Search ..... 222/146.5, 333; 219/630, 647, 660, 240, 241

[56] References Cited

U.S. PATENT DOCUMENTS

| | | | |
|---|---|---|---|
| 2,178,720 | 11/1939 | Daniels | 219/630 |
| 2,226,446 | 12/1940 | Smith et al. | 219/630 |
| 2,226,447 | 12/1940 | Smith et al. | 219/630 |
| 3,238,346 | 3/1966 | Savko | 219/633 |
| 3,485,417 | 12/1969 | Cocks | 222/146.5 X |
| 3,543,968 | 12/1970 | Beighard | 222/146.1 |
| 3,620,289 | 11/1971 | Phipps, Jr. | 219/632 X |
| 3,744,921 | 7/1973 | Weller et al. | 219/230 X |
| 3,877,610 | 4/1975 | Dickey | 222/146.5 |
| 3,996,402 | 12/1976 | Sindt | 219/633 X |
| 4,032,046 | 6/1977 | Elliott et al. | 222/146.5 |
| 4,059,204 | 11/1977 | Duncan et al. | 222/146.5 |
| 4,067,481 | 1/1978 | Feldman | 222/146.5 |
| 4,144,913 | 3/1979 | Akers et al. | 222/146.5 X |
| 4,289,257 | 9/1981 | Herb et al. | 222/146.5 |
| 4,463,877 | 8/1984 | Siwon | 222/146.5 |
| 4,478,669 | 10/1984 | Zeller et al. | 219/603 |
| 4,560,849 | 12/1985 | Migliori et al. | 219/628 |
| 4,590,347 | 5/1986 | Thatcher et al. | 219/660 X |
| 4,938,388 | 7/1990 | Yeh | 222/146.5 |
| 5,101,086 | 3/1992 | Dion et al. | 219/660 X |

*Primary Examiner*—Kevin P. Shaver
*Attorney, Agent, or Firm*—James E. Bradley

[57] ABSTRACT

A method and apparatus are provided for heating a solid material and dispensing the material as a liquid. A central housing has an inlet, a dispensing orifice and a flow passage extending through the central housing for passing the material from the inlet to the dispensing orifice. A susceptor and induction coil are disposed within the flow passage for immersion within the material after it is liquified. The susceptor includes a conically shaped flow section which extends across the flow passage, and a plurality of flow ports for passing the material. The susceptor further includes a cylindrical section which extends downstream from the flow section for receiving the material from the flow section and passing material to the dispensing orifice. The induction coil is aligned with and spaced downstream from the flow section of the susceptor, surrounding part of the susceptor for electromagnetically inducing electric currents to flow within the flow section.

20 Claims, 2 Drawing Sheets

MAGNETICALLY HEATED SUSCEPTOR

BACKGROUND OF THE INVENTION

1. Field of the Invention

This invention relates in general to heating and dispensing materials, and in particular to devices for electromagnetically heating and dispensing materials.

2. Description of the Prior Art

Prior art devices have been utilized for heating and dispensing materials, such as for heating a solid material until it melts and then dispensing the material as a liquid. For example, hot glue guns are used for heating an end of a solid glue stick to a transition temperature at which the glue is liquefied and then dispensing the melted glue through a dispensing orifice. Typically, a housing is provided having an interior flow path through which the material is pushed as it is heated. Resistance heating elements are commonly used. The resistance heating elements have been mounted to the housing outside of the flow path, and often outside of the housing.

Other devices have utilized induction heating to heat materials for dispensing. A housing is usually provided having an interior flow path through which the material is pushed as it is heated. An electromagnetically heated susceptor is located either directly in or immediately adjacent to the material flow path. Induction coils have been mounted outside of the housings for inducing eddy currents to flow within the susceptors to generate heat for transferring to the materials. Often an external shroud is provided around the induction coil to protect an operator. Heat from passing current through the induction coil usually has to be removed to prevent overheating of the coil. Forced cooling is often used, resulting in wasted energy. External shrouds and cooling devices for induction coils also add additional weight and size to such prior art devices.

Inductive heating devices having large material flow capacities require that a large surface of the material be heated at one time. For melting materials, this results in susceptors having large heat transfer surface areas for contacting materials at melt faces for the materials. In order to prevent cold spots over the large heat transfer surface areas of such susceptors, the susceptors are made to have high heat capacities and high thermal conductivities. Although susceptors having high heat capacities in combination with high thermal conductivities add additional weight to prior art devices, they provide substantially uniform temperatures across the heat transfer surface areas, even those portions of the surface areas which are more remote from induction coils than others. However, when inductive heating of the susceptor is stopped, the large heat capacity of such susceptors will result in continued heat transfer to the material, often to a significant depth within the material beyond the melt face. This not only wastes energy, but may also result in waste of the material being heated.

SUMMARY OF THE INVENTION

A method and apparatus are provided for heating and dispensing a material. A central housing has an inlet, a dispensing orifice and a flow passage extending through the central housing for passing the material from the inlet to the dispensing orifice. A susceptor and induction coil are disposed within the flow passage for immersing within the material. The susceptor includes a conically shaped flow section which extends across the flow passage, and a plurality of flow ports for passing the material. The susceptor further includes a cylindrical section which extends downstream from the flow section for receiving the material from the flow section and passing material to the dispensing orifice. The induction coil is aligned with and spaced downstream from the flow section of the susceptor, surrounding part of the susceptor for electromagnetically inducing electric currents to flow within the flow section. The induced electric currents are substantially uniform across the flow section to provide a substantially uniform thermal transfer from the flow section to a melt face for the material. The flow section has a limited heat capacity such that the flow section will not contain an amount of heat sufficient to significantly raise the temperature of the material adjacent to the flow section when the electric currents are stopped, preventing thermal transfer from the susceptor to a significant portion of the material beyond the melt face.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
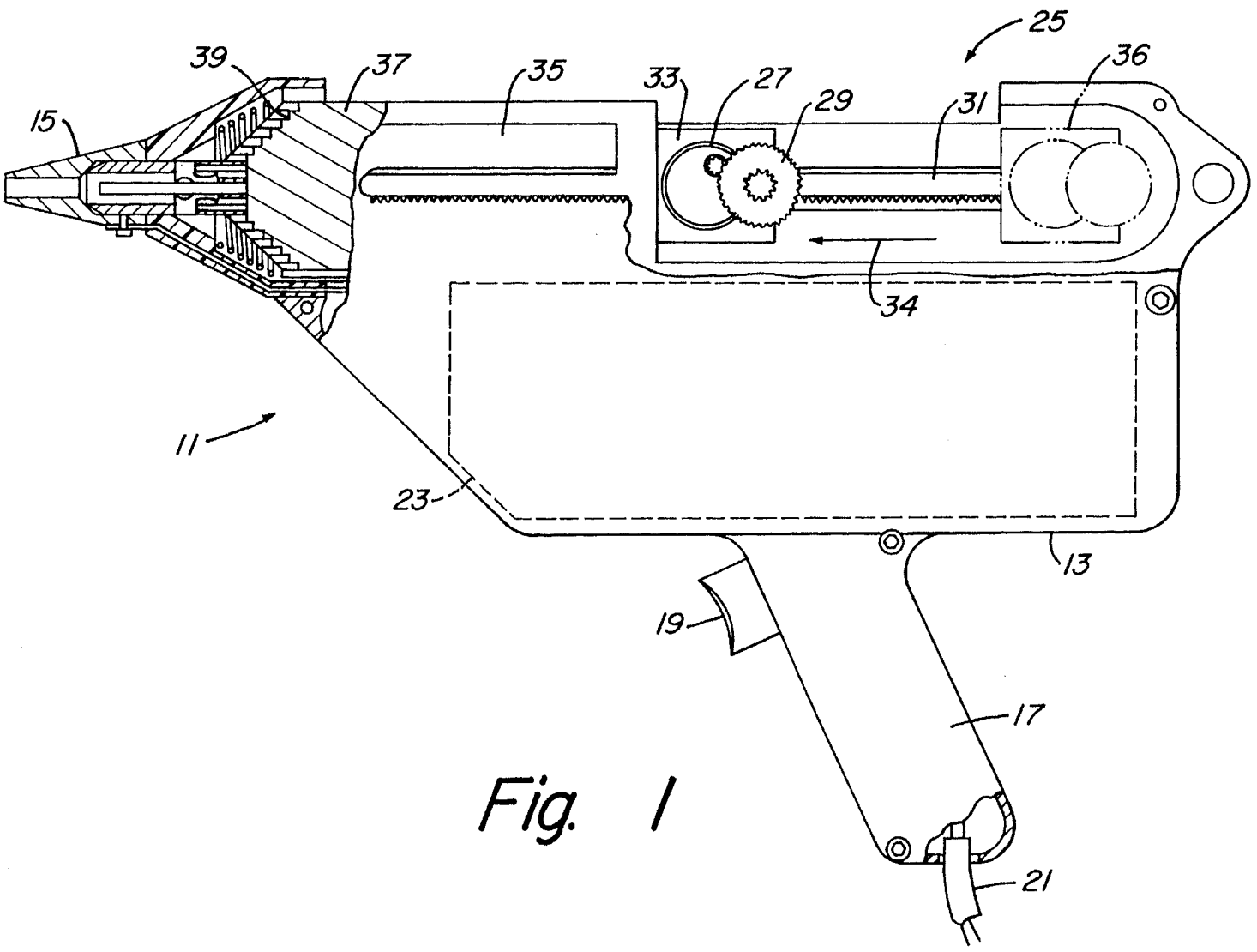
FIG. 1 is a side elevational and partial section view of a hot glue gun having an electromagnetically heated susceptor made according to the present invention.

FIG. 1 is a side elevational view of hot glue gun 11 of the present invention. Gun 11 is used for heating, liquefying and dispensing solid sticks of glue which nominally measure two (2) inches in diameter and eight (8) inches in length. Gun 11 has a body 13 and a nozzle tip 15. Grip handle 17 is provided for holding gun 11, and includes a trigger type of button 19 for controlling heating and dispensing of the hot glue. Power cord 21 extends from handle 17 and connects to power supply 23, which preferably is a 110 volt AC source.

Feed assembly 25 provides a means for pushing a glue stick into nozzle tip 15. Feed assembly 25 includes a stepper motor 27 which is connected by means of gear 29 to rack 31. Stepper motor 27 and gear 29 are mounted to driven member 33, which is moved in direction 34 within cavity 35. An intermediate position for driven member 33, stepper motor 27 and gear 29 is depicted in FIG. 1. A rearward position 36 is depicted in phantom for driven member 33, stepper motor 27 and gear 29. Glue stick 37 is placed in cavity 35, forward of driven member 33. Glue stick 37 has a forward end 39 for pressing into nozzle tip 15. Stepper motor 27 is actuated to move driven member 33 forward in direction 34, from position 36 to the intermediate position depicted in FIG. 1. This presses the forward face 39 of glue stick 37 into the rearward end of susceptor 53.

Figure 2:
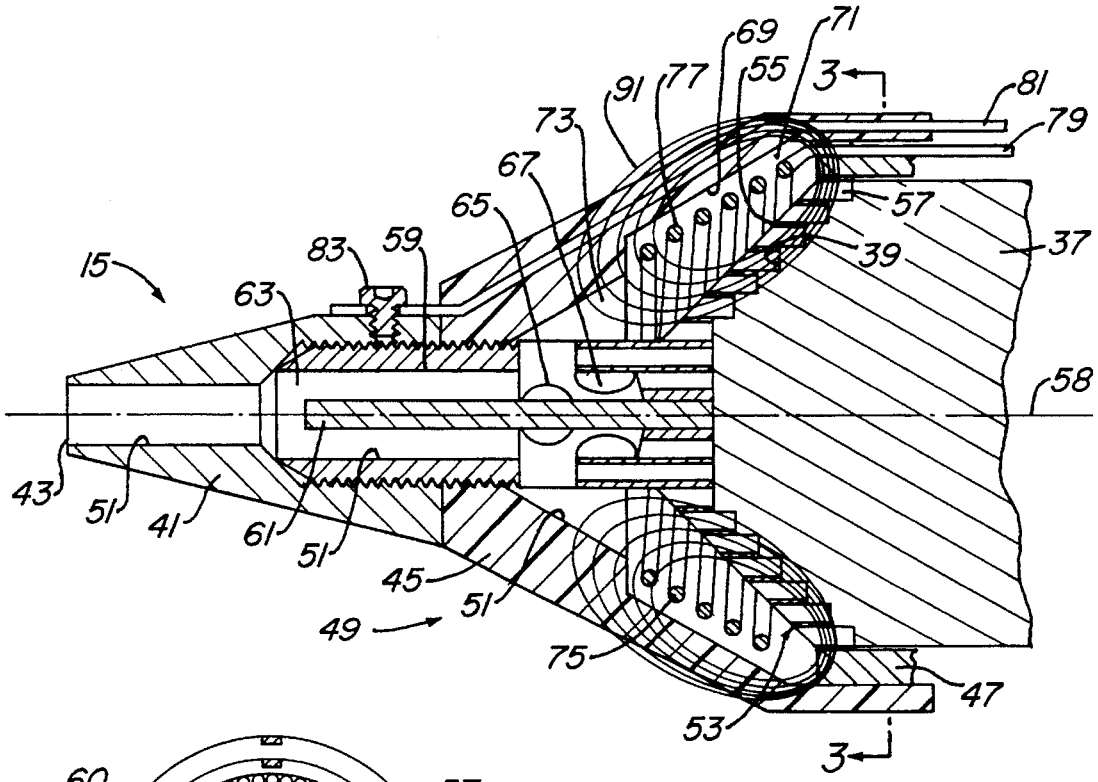
FIG. 2 is a partial longitudinal section view depicting the nozzle tip of the hot glue gun of FIG. 1 in more detail.

FIG. 2 is a sectional view depicting nozzle tip 15 in more detail. Nozzle 41 is formed from aluminum and has a dispensing orifice 43. A housing 45 of a plastic material, such as teflon, extends rearward of nozzle 41, and has a conical shape. A cylindrical member 47 extends rearward of housing 45. Nozzle 41, housing 45, and cylindrical member 47 together define a central housing 49 having interior bore 51. Bore 51 provides a flow passage for passing glue through housing 49.

Susceptor 53 extends within housing 49, across a rearward section of bore 51. Susceptor 53 includes a conical flow section 55, having a thin cross section with a heat capacity which is not substantially greater than a thin section of the material extending across the melt face at forward end 39 of glue stick 37. Conical flow section 55 has an outer diameter of two (2) inches. Holes 57 extend through the rearward portion of susceptor 53 to provide flow ports through flow section 55. Holes 57 are parallel to central longitudinal axis 58.

Figure 3:
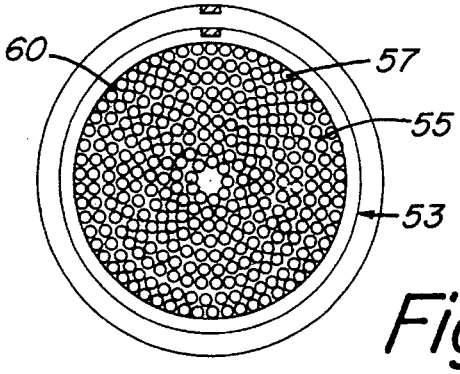
FIG. 3 is sectional view taken along section line 3—3 of FIG. 2, and depicts the rearward facing end of the susceptor.

FIG. 3 is a sectional view taken along section line 3—3 of FIG. 2, and depicts holes 57 extending through the conically shaped, rearward facing end of susceptor 53. In this embodiment of the present invention, approximately 51% of the rearward facing surface end of susceptor 53 is holes, providing a reduced heat capacity for susceptor 53. The solid portion 60 of the conically shaped, rearward facing end of susceptor 53 contacts forward face 39 of material 37 to define a melt face. The melt face also extends within holes 57 when solid material is pushed into holes 57. Thus the effective heat transfer surface area for susceptor 53 at the melt face includes both solid portion 60 of the rearward facing end of susceptor 53 and at least a portion of the periphery of holes 57.

Referring to FIG. 2, susceptor 53 further includes cylindrical section 59 and thermal transfer member 61. In the preferred embodiment, flow section 55 and cylindrical section 59 are formed from various materials within which an electric current can be electromagnetically induced to flow. Thermal transfer member 61 is formed from a non-ferrous material, and provides a means for transmitting electromagnetically induced heat forward from the rearward portion of flow section 55 so that restarting of glue flow from gun 11 can be more quickly accomplished than if member 61 were not included. The components of susceptor 53 may be formed of other materials, so long as flow section 55 is formed from materials within which may be electromagnetically heated by inducing eddy currents to flow therein.

The exterior of cylindrical section 59 is threaded. The rearward end of nozzle 41 is threaded and secures to cylindrical section 59, and the forward end of housing 45 is also threaded for coupling to cylindrical section 59. Cylindrical section 59 will conduct high frequency electric current from flow section 55 to nozzle 41, which is also conductive.

Annular space 63 extends between cylindrical section 59 and thermal transfer member 61 of susceptor 53. Four flow ports 65 and four flow ports 67 extend through cylindrical section 59 to connect annular space 63 to annular space 69, which extends between housing 45 and flow section 55. Flow ports 65, 67 are offset both angularly and longitudinally along a central axis for central housing 49. Annular space 69 has a conical shape, which extends with a narrower width at outermost portion 71 than at inner portion 73. Inner portion 73 is wider to provide a constant cross sectional flow area per unit amount of glue flowing through annular space 69. Annular space 69 is formed between housing 45 and flow section 55 of susceptor 53. The forward face of flow section 55 is at a 45 degree angle to central longitudinal axis 58 for flow passage 51 in central housing 49. The interior, conically shaped surface of housing 45 is at a 30 degree angle to longitudinal axis 58 for flow passage 51 and central housing 49.

Induction coil 75 is conically shaped and located within conically shaped annular space 69. Forward end 77 of coil 75 is welded to the forward end for flow section 55 of susceptor 53. Wire 79 extends from the rearward end of coil 75 to electrically connect coil 75 to power supply 23 (shown in FIG. 1). Wire 81 extends through housing 45 to ground screw 83 and nozzle 41. This provides an electrical connection for connecting power supply 23 to the forward end 77 of coil 75, which is welded to susceptor 53. Susceptor 53 will conduct the high frequency current to nozzle 41 and ground screw 83.

Figure 4:
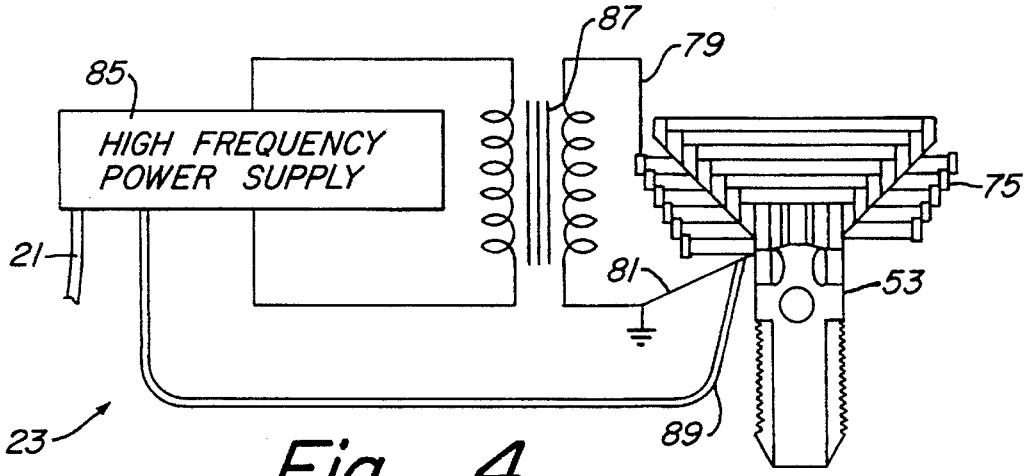
FIG. 4 is a schematic diagram illustrating an electromagnetic circuit for a power supply, an induction coil and a susceptor for the hot glue gun of FIG. 1.

FIG. 4 is a schematic diagram depicting an electromagnetic circuit which includes power supply 23, susceptor 53 and induction coil 75. Power supply 23 includes high frequency power supply 85 which is connected by means of power cord 21 to an external power source. Power supply 23 nominally operates at frequencies of 50 kHz, with the frequency typically being lowered for susceptors of larger dimension, and can be powered from a 20 amp 110 volt a.c. outlet. Transformer 87 is electrically connected between high frequency power supply 85 and induction coil 75 by means of wires 79, 81. Thermocouple 89 is provided for controlling the temperature of susceptor 53. Power supply 23 has a variable temperature set point for accommodating glues of different melting temperatures.

Referring to FIG. 2, in operation, high frequency electrical current flowing through induction coil 75 causes an electromagnetic field, depicted as the lines of electromagnetic flux 91 passing through susceptor 53. Electromagnetic flux 91 causes eddy currents to flow within susceptor 53, which generate heat. The forward end 39 of glue stick 37 is pressed inward to susceptor 53 by feed assembly 25 (shown in FIG. 1). This causes the end face 39 of glue stick 37 to melt and flow through ports 57 into conically shaped annular space 69. The melted glue then flows from annular space 69 through flow ports 65, 67, into cylindrically shaped annular space 63, and through dispensing orifice 43 of nozzle 41. Melted glue flowing past induction coil 75 removes heat from coil 75, cooling coil 75. It should be noted that the cross-sectional flow area for the total combined flow ports 57 in susceptor 53 is equal to the effective cross-sectional flow area of annular space 69, flow port 65, 67, and annular space 63 after coil 75 and susceptor 53 are installed within central housing 49. This prevents flow restrictions from occurring as the melted glue passes through flow passage 51.

It should be noted that after holes 57 are formed into flow section 55, the heat capacity for flow section 55 is limited such that it is capable of only containing enough heat for melting only a very fine, thin layer of the face 39 of glue stick 37. The low heat capacity for flow section 55 will not contain an amount of heat sufficient to raise the temperature of a significant portion of the glue material adjacent to the flow section beyond the melt-phase transition temperature, that is beyond the temperature at which the glue melts. This provides for a very finely controlled, thin melt face for glue stick 37. Thus, once the high frequency electric current is turned off from flowing within induction coil 75, the glue at melt face 39 almost immediately stops melting.

Cylindrical section 59 is formed from a ferrous material and receives some of the electromagnetic field flux 91 from induction coil 75. This causes eddy currents to flow in cylindrical section 59, generating heat for transferring to the material adjacent to section 59 in annular space 63. Additionally, thermal transfer member 61 transfers heat to the glue within annular space 63 to help liquefy the material to initiate flow as glue gun 11 is cycled back on to dispense more glue through orifice 43. Heat from coil 75 and heat induced within flow section 55 will quickly liquefy any glue that solidifies within annular space 69 when gun 11 is cycled off.

Other embodiments of the present invention may be made for heating and dispensing materials. It should be noted that in other embodiments of the present invention, susceptors may be made from materials other than ferrous materials, such as ceramic and carbon materials capable of having electric currents induced to flow therein. One such example is a susceptor having a carbon core which is coated with silicon carbide. Such materials will allow use of the present invention at temperatures which are much higher than those for melting glue.

The present invention provides several advantages over prior art devices for heating and dispensing materials, such as glue. The present invention provides a very finely controlled, thin melt face transition by providing a susceptor having a low heat capacity so that any thermal transfer from the susceptor to the melt face will be quickly absorbed by the adjacent material at the melt face. Also, the induction coil according to the present invention surrounds and extends along a portion of the susceptor so that uniform currents can be generated across different sections of the susceptor. The induction coil is within a flow passage and immersed within the material to both cool the induction coil and use heat which is normally lost by exteriorly mounted induction coils. Additionally, a thermal transfer member extends forward of the flow section of the susceptor for transferring induced heat forward to improve recovery times when material flow is cycled back on.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. An apparatus for heating and dispensing a material, the apparatus comprising in combination:

a central housing having an inlet, a dispensing orifice, and a flow passage extending through the central housing for passing the material from the inlet to the dispensing orifice;

a susceptor disposed within the flow passage and in the material; and an induction coil disposed within flow passage for immersion in the material, and disposed proximate to the susceptor for electromagnetically inducing the susceptor to heat the material.

2. The apparatus according to claim 1, wherein the susceptor comprises:

a flow section which extends across the flow path having a plurality of flow ports for passing the material therethrough; and wherein the induction coil electromagnetically induces electric currents to flow within the flow section, which generates and transfers heat to the material passing through the flow ports.

3. The apparatus according to claim 1, wherein the susceptor comprises:

a flow section having a conical shape which extends across the flow path and which converges toward the dispensing orifice, and the flow section further having a plurality of flow ports for passing the material therethrough;

a cylindrical section which extends downstream of the flow section for receiving the material from the flow section and passing the material to the dispensing orifice; and wherein the induction coil electromagnetically induces electric currents to flow within both the flow section and the cylindrical section, which generates and transfers heat to the material passing through the flow section and the cylindrical section.

4. The apparatus according to claim 1, wherein:

the susceptor includes a flow section which extends across the flow path and has a plurality of flow ports for passing the material therethrough; and the induction coil is aligned with and spaced downstream from the flow section of the susceptor for electromagnetically inducing electric currents to flow within the flow section which provide substantially uniform thermal transfer across the flow section to the material passing through the flow ports.

5. The apparatus according to claim 1, wherein:

the susceptor has an axis and includes a flow section which extends across the flow path, and the flow section has a plurality of flow ports for passing the material therethrough; and the induction coil has an axis that is coaxial with the axis of the susceptor and the induction coil surrounds at least a portion of the susceptor for electromagnetically inducing substantially uniform electric currents to flow across the flow section.

6. The apparatus according to claim 1, wherein:

the susceptor includes a flow section which extends across the flow path and has a plurality of flow ports for passing the material therethrough; and the flow section has a heat capacity such that the flow section will not contain an amount of heat sufficient to raise the temperature of a significant portion of the material adjacent to the flow section beyond a transition temperature.

7. The apparatus according to claim 1, further comprising:

a thermal transfer member formed from a non-ferrous material and extending within the flow passage, downstream of the susceptor, for transferring heat from the susceptor to a portion of the material after is passes through the susceptor.

8. The apparatus according to claim 1, wherein the susceptor comprises:

a thin conical section which extends across the flow path and has a plurality of flow ports for passing the material therethrough, with the thin conical section converging toward the dispensing orifice;

a cylindrical section which extends downstream of the thin conical section for receiving the material from the thin conical section and passing the material to the dispensing orifice;

wherein the induction coil electromagnetically induces electric currents to flow within both the thin section and the cylindrical section, which generates and transfers heat to the material passing through the flow ports of the thin conical section and the cylindrical section; and wherein the apparatus further comprises a thermal transfer member formed from a non-ferrous material and extending within the flow passage, downstream of the susceptor, for transferring heat from the susceptor to a portion of the material after is passes through the susceptor.

9. The apparatus according to claim 1, wherein:

the susceptor has a flow section which extends across the flow path and has a plurality of flow ports for passing the material therethrough;

wherein the flow section has a heat capacity such that the flow section will not contain an amount of heat sufficient to raise the temperature of a significant portion of the material adjacent to the flow section beyond a transition temperature;

the induction coil is disposed within the flow passage downstream from, aligned with and spaced apart from the susceptor for electromagnetically inducing electric currents to flow within the flow section which provide for a substantially uniform thermal transfer across the flow section of susceptor to the material flowing through the flow ports; and wherein the apparatus further comprises a thermal transfer member formed from a non-ferrous material and extending within the flow passage, downstream of the susceptor, for transferring heat from the susceptor to a portion of the material after is passed through the susceptor.

10. An apparatus for heating a solid material to convert it to a liquefied material and for dispensing the liquefied material, the apparatus comprising in combination:

a central housing having an inlet, a dispensing orifice, and a flow passage extending through the central housing for passing the liquefied material from the inlet to the dispensing orifice;

a susceptor having a conical flow section which extends across the flow passage and converges toward the dispensing orifice, the flow section having a plurality of flow ports for passing the liquefied material therethrough;

an induction coil disposed within the flow passage for immersion in the liquefied material, and being conically shaped to converge toward the dispensing orifice and partially surround the susceptor; and wherein the induction coil electromagnetically induces electric currents to flow within conical flow section of the susceptor to heat and liquefy the solid material.

11. The apparatus according to claim 10, wherein the flow passage through the central housing defines an annular flow passage having a conical shape which extends between the susceptor and the induction coil, and radial distances across the annular flow passage increase as the annular flow passage converges toward the dispensing orifice.

12. The apparatus according to claim 10, wherein the flow passage through the central housing defines an annular flow passage having a conical shape which extends between the susceptor and the induction coil, and the annular flow passage has a substantially constant cross-sectional flow area as the annular flow passage converges toward the dispensing orifice.

13. The apparatus according to claim 10, wherein the flow ports are defined by substantially constant diameter holes which are spaced apart to provide a substantially constant cross-sectional flow area through the susceptor.

14. The apparatus according to claim 10, further comprising:

a thermal transfer member formed from a non-ferrous material and extending within the flow passage, downstream of the susceptor, for transferring heat from the susceptor to a portion of the material after is passes through the susceptor.

15. The apparatus according to claim 10, further comprising:

means for pushing the material relative to the susceptor and through the flow passage.

16. An apparatus for heating a stick of glue above a transition temperature at which the glue melts to change from a solid phase to a liquid phase, and for dispensing the glue in the liquid phase, the apparatus comprising in combination:

a central housing having an inlet for receiving the glue in a solid phase, a dispensing orifice for dispensing the glue in a liquid phase, and a flow passage extending through the central housing for passing the glue from the inlet to the dispensing orifice;

a susceptor having a conical flow section which extends across the flow passage and converges towards the dispensing orifice, the conical flow section having a plurality of flow ports for passing the glue therethrough when the glue is in the liquid phase, wherein the flow ports define a substantially constant cross-sectional flow area through the conical flow section;

wherein the susceptor and the central housing together define an annular flow passage having a conical shape which extends therebetween, and the annular flow passage has a substantially constant cross-sectional flow area as the annular flow passage converges toward the dispensing orifice;

an induction coil disposed within the annular flow passage for immersion within the glue, and being conically shaped to converge toward the dispensing orifice and extend at least partially around the conical flow section of the susceptor; and wherein the induction coil electromagnetically induces substantially uniform electric currents to flow within the conical flow section of the susceptor to provide a substantially uniform thermal transfer from the susceptor to the glue flowing within the flow ports.

17. A method for heating, liquefying and dispensing a material, the method comprising the steps of:

providing a housing having a central cavity, and a susceptor and an induction coil disposed within a central cavity;

placing the material within the central cavity on one side of the susceptor;

passing an electric current within the induction coil to cause the induction coil to emit a electromagnetic field to the susceptor, causing the susceptor to emit heat to the material;

passing the material through the susceptor to liquefy the material; and passing the liquefied material through the induction coil, immersing the induction coil within the material.

18. The method according to claim 17, wherein the coil is disposed downstream of the susceptor.

19. The method according to claim 17, wherein the coil is disposed downstream of the susceptor and partially surrounds the susceptor.

20. The method according to claim 17, wherein the electric current is a high frequency electric current.

* * * * *